US005487634A

United States Patent [19]

Vercillo

[11] Patent Number: 5,487,634

[45] Date of Patent: Jan. 30, 1996

[54] PUNCH SELECTABLE PUNCH PRESS

[75] Inventor: Al Vercillo, Harwood Heights, Ill.

[73] Assignee: General Binding Corporation, Northbrook, Ill.

[21] Appl. No.: 266,231

[22] Filed: Jun. 27, 1994

[51] Int. Cl.[6] ..... B42B 9/00

[52] U.S. Cl. ..... 412/16; 412/38; 412/9

[58] Field of Search ..... 412/9, 16, 38, 412/33; 281/15.1, 21.1; 83/448–450, 549–570

[56] References Cited

U.S. PATENT DOCUMENTS

| | | | |
|---|---|---|---|
| 2,108,136 | 2/1938 | Nelson et al. . | |
| 2,358,062 | 9/1944 | Farkas . | |
| 3,125,887 | 3/1964 | Bouvier et al. . | |
| 3,153,966 | 10/1964 | Frederick et al. . | |
| 3,227,023 | 1/1966 | Bouvier . | |
| 3,427,914 | 2/1969 | Staats et al. . | |
| 3,793,660 | 2/1974 | Sims . | |
| 4,480,782 | 11/1984 | Morishima . | |
| 4,569,267 | 2/1986 | Klingel . | |
| 4,610,590 | 9/1986 | Pigna | 412/38 X |
| 4,645,399 | 2/1987 | Scharer . | |
| 4,656,907 | 4/1987 | Hymmen . | |
| 4,898,055 | 2/1990 | Neilsen . | |
| 5,007,782 | 4/1991 | Groswith, III et al. . | |
| 5,183,361 | 2/1993 | Ho | 412/16 |
| 5,366,333 | 11/1994 | Crudo et al. | 412/16 |

*Primary Examiner*—Willmon Fridie, Jr.
*Attorney, Agent, or Firm*—Hill, Steadman & Simpson

[57] ABSTRACT

For a punch mechanism, a selector rail which by shifting can change the punch hole pattern by activating or deactivating select punches along the rail. In a preferred embodiment, the punch can be quickly changed from a three hole standard punch to a two hole standard punch by activating and deactivating two select punches. The selector rail locks to the selected punch for both driving and retraction of the punch by force of an electric motor and gear train.

14 Claims, 2 Drawing Sheets

PUNCH SELECTABLE PUNCH PRESS

BACKGROUND OF THE INVENTION

The present invention relates to punch press dyes, and particularly to means for selecting groups of punches from an available supply of punches to selectively choose the hole spacing to be punched.

Hole punching machines can be manually or electrically operated. A manual punching machine is described, for example, in U.S. Pat. No. 4,645,399. Electric punch machines are described, for example, in U.S. Pat. No. 3,153,966, 3,427,914 and 3,793,660. In these machines, a series of pins which are carried by a pressure bar are adapted to overlie individual punches and are thus selected for the desired hole pattern. However, the pins must be set individually. A convenient selection of groups of punches for a desired hole pattern is not disclosed.

SUMMARY OF THE INVENTION

It is an object of the present invention to provide a punch apparatus for allowing selective operation of individual punches alone or in groups, selected from a group of punches within a punch press to form a desired hole pattern. It is an object of the present invention to provide a punch extending and retracting mechanism which positively grips the selected punches to both instigate punching as well as retraction of the punches from the punched paper. It is an object of the present invention to provide a selection arrangement for punches which is easily switched between at least two positions corresponding to two desired hole patterns for punching paper.

The objects are inventively achieved in providing a reciprocating selection plate having notches registered with a plurality of punches. By shifting the selection plate, a notch(es) engages a selected punch(es) whereas another notch(es) is moved to free a selected punch(es). The punches have a shoulder for being engaged by the selection plate and a C-clip arranged above the selection plate. The shoulder and C-clip together form an annular groove for reception of the selection plate at the notch. The selection plate is carried by the pressure bar and after engaging a selected punch(es) is reciprocated toward the paper with the punch(es) captured in the notch(es) being depressed toward the paper bar. After the punching operation is complete, the pressure bar is reversed, the selection plate abutting against the C-clips to retract punches from the thus punched paper.

At least one of the punches is spring biased away from the paper. By providing a positive retraction of the punches as opposed to relying on individual punch spring pressure alone, the spring(s) can be of a lesser spring force constant since they need not be the primary driving force for retracting the punches through the punched paper.

DETAILED DESCRIPTION OF THE PREFERRED EMBODIMENTS

Figure 1:
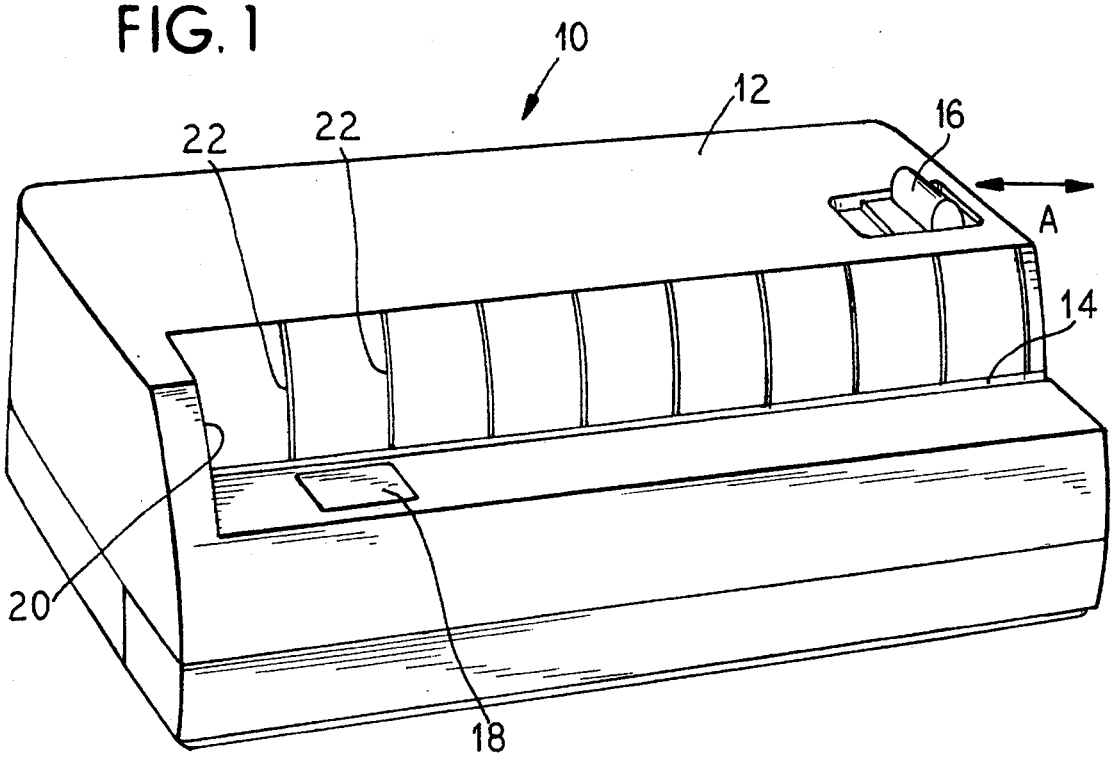
FIG. 1 is a perspective view of an electric punch machine of the present invention.
Figure 2:
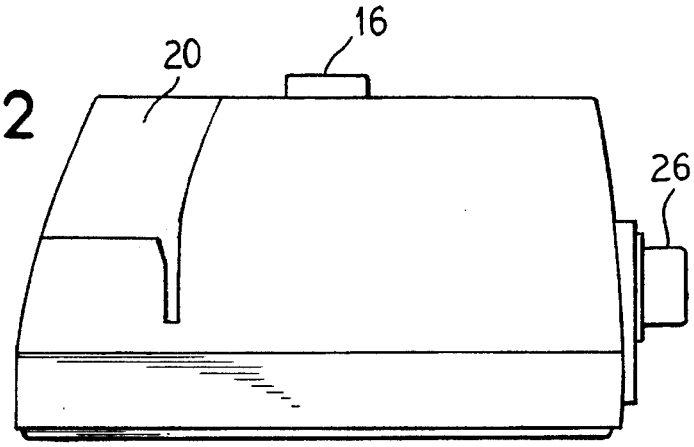
FIG. 2 is a side view of the punch of FIG. 1.
Figure 3:
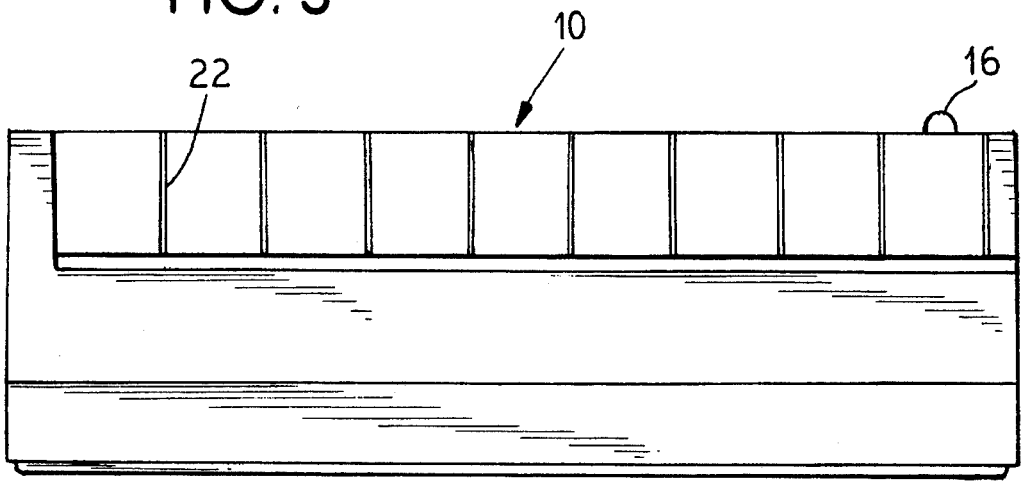
FIG. 3 is a front view of the punch of FIG. 1.

FIGS. 1–3 illustrate a paper punch 10 having a cover 12, a paper feed slot 14 for vertical loading of paper, a punch selector lever 16 and a punch operating button 18. A side wall 20 is used to align the paper being punched. Additionally, ribs 22 can be used to align the paper being punched. The selector button 16 is reciprocal in the direction A to select groups of punches. The operating button 18 controls a switch (not shown) to instigate punching.

FIG. 2 illustrates an adjustment knob 26 which is used to adjust an initial position of the punches if they become stalled in extension.

Figure 4:
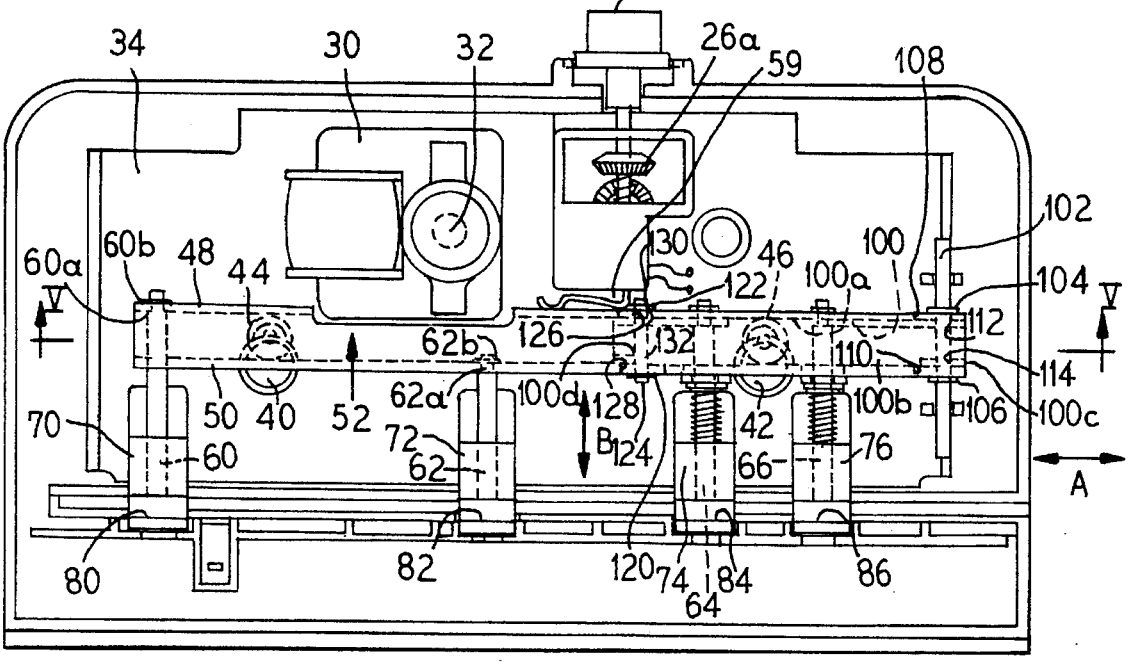
FIG. 4 is a top view of the punch of FIG. 1 with the cover removed for clarity.

FIG. 4 illustrates a drive motor 30 of the punch press which has an axle 32 which penetrates down beneath a chassis 34. Below the chassis 34 is mounted a plurality of gears in a gear train which receive rotary force from the shaft 32. The complete gear train which underlies the chassis 34 is not shown as such arrangement is known in the art. However, extending up from below the chassis and as output shaft of the gear train are two cam shafts 40, 42 which connect to offset rollers 44, 46 which are captured between side flanges 48, 50 of a channel-shaped pressure bar 52. When the shafts 40, 42 are rotated simultaneously and in the same rotational directions, the rollers, 44, 46 being offset from the cam shafts 40, 42, reciprocate the drive channel 52 in the direction B to either punch or retract.

In this embodiment there are four punches: a first punch 60, a second punch 62, a third punch 64 and a fourth punch 66, respectively. The punches are elongate cylinders which are journaled in a first block 70, a second block 72, a third block 74 and a fourth block 76, respectively. The blocks provide paper receiving first slot 80, a second slot 82, a third slot 84 and a fourth slot 86, respectively which are in registry with the paper receiving slot 14. In FIG. 4 the punches are shown in their retracted position. When paper is to be punched, the punches 60, 62, 64 and 66 would bridge the slots 80, 82, 84 and 86 to punch through the paper. In the shown embodiment, the first and second punches 60, 62 are fixed to the side walls 48, 50 respectively by a shoulder portion **60*a* of the punch 60 and a C-clip 60*b* on opposite sides of the side wall 48, and by a shoulder portion 62*a* and a C-clip 62*b* on opposite sides of the side wall 50. Therefore, according to this embodiment, these two punches would always reciprocate in the direction B with the pressure bar 52**.

The third and fourth punches 64, 66, however, are alternately selectable. When the third punch 64 is selected then the second and third punches 62, 64 provide standard two hole punching. The first punch being active but outside the edge of the fed paper. When the fourth punch 66 is selected, then the punches 60, 62 and 66 provide standard three hole punching. An electric switch 59 senses the complete retraction of the pressure bar 52 and can then shut off the motor 30.

To select alternately the punch 64 or 66 a selector rail 100 is used. The selector rail is of a generally L-shaped in cross section having a side wall **100*a* and a top wall 100*b* with tabs 100*c*, 100*d* and interfit closely within the side walls 48, 50 of the pressure bar 52. At one end of the pressure bar 52 an activator pin 102 is captured by two C-clips 104, 106 onto the pressure bar 52 and within a slot 108 through the side wall 48 and a slot 110 through the side wall 50. The pin penetrates the rail 100 through top aperture 112 through the side wall 100***a* and bottom aperture 114 through the tab 100*c*. Thus, the activator pin can slide with the rail 100 through the slots 108, 110 of the pressure bar 52. The pin 102 is fixedly gripped by the selector lever (not shown) 16 to be reciprocatable along the direction A by movement of the selector lever.

At an opposite end of the rail 100, a guide pin 120 is captured by a top C-clip 122 and a bottom C-clip 124 to the pressure bar 52 and is arranged through apertures 130, 132 of the side wall 100*a* and tab 100*d* of the rail 100. This guide pin 120 acts as a guide for reciprocal movement of the rail 100 within the pressure bar 52.

Figure 5:
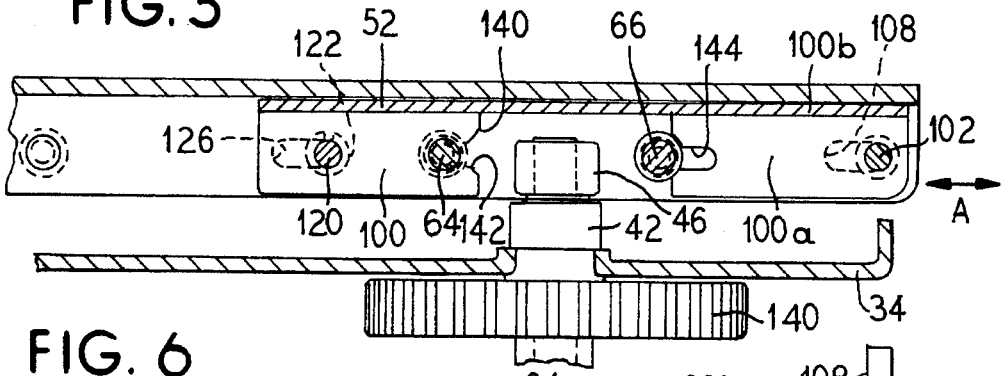
FIG. 5 is a partial sectional view taken generally alone line V—V of FIG. 4.

As shown in FIG. 5, the cam shaft 42 is connected below the chassis 34 to a drive gear 140 which is enmeshed with the gear train (not shown) which is gear connected (not shown) to the motor shaft 32.

The rail 100 is shown which has a central cut-out 140 with inwardly facing notches 142, 144 which are slidable with the rail 100 to capture either the third punch 64 or the fourth punch 66 and release the respective other. When the rail 100 is slid to the left, the notch 144 captures the fourth punch 66 and the notch 142 releases the third punch 64.

The method of capturing the punches will be described with regard to FIG. 6. The third punch 64 is shown in a paper-punched condition being extended fully in the direction B bridging the paper slot 84 where paper located therein would be punched. The fourth punch 66 on the other hand has not been moved in the direction B and remains retracted from the slot 86. The rail 100 has been slid to the right and the notch 142 has been inserted between a shoulder 64*a* and a C-clip 64*b* of the third punch 64. The fourth punch 66 also has a shoulder 66*a* and a C-clip 66*b*, but the notch 144 has been retracted away from the fourth punch 66 so that the punch can escape through a large aperture 150 arranged in the side wall 48 of the pressure bar 52. An enlarged aperture 152 is provided for the third punch 64. Each of these punches provides a spring 154, 156 which assists in returning the punch and helps in effect to drive the pressure bar 52 to a retracted position.

Figure 6:
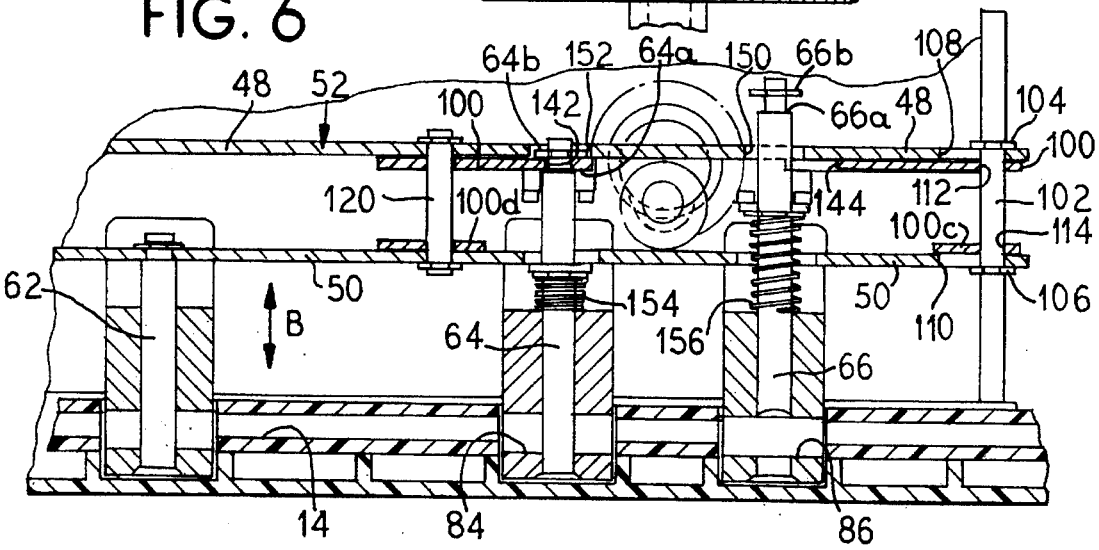
FIG. 6 is an enlarged sectional view of a portion of the press shown in FIG. 4.

The present invention provides for a motor retraction of the punches with the pressure bar 52, and in particular, the selected punch such as the third punch 64 shown in FIG. 6, because the rail 100 positively captures the punch for movement in both directions of B by abutting either the C-clip 64 or the shoulder 64*a*, depending on direction of movement of the pressure bar 52. If the fourth punch 66 was selected, the pressure bar 52 would translate the fourth punch 66 in both a punching and retraction direction.

If, however, the motor did not return the punches to a completely retracted position due, for example, an overload of paper causing the motor to stall and cut off too soon, the adjuster 26 having pinion 26*a* is geared to the gear train (not shown) which when manually turned will retract or extend the pressure bar 52 manually. This can be undertaken to return the punches to the completely retracted position and thereby disconnecting power to the drive motor 30 via the electric switch 59.

Although the present invention has been described with reference to a specific embodiment, those of skill in the art will recognize that changes may be made thereto without departing from the scope and spirit of the invention as set forth in the appended claims.

I claim as my invention:

1. In a punch press having a plurality of punches arranged to punch holes through sheets, the improvement comprising:

a pressure bar reciprocatable toward and away from sheets to be punched;

a first punch and a second punch arranged spaced along said pressure bar and movably inserted through respective holes in the pressure bar, the first and second punch having first and second groove formations respectively;

a selector rail mounted reciprocally with respect to said pressure bar and having notches alignable with and facing said first and second groove formations of said punches, reciprocation of said selector rail in a first direction engaging a first notch to said first groove formation and disengaging said second notch from said second groove formation, and reciprocating said selector rail in an opposite direction disengaging said first notch from said first groove formation and engaging said second notch to said second groove formation;

said selector rail movable with said pressure bar toward said paper to instigate punching of said sheets; and a respective one of said first and second punches, once disengaged from said selector rail is disengaged from said pressure bar.

2. The improvement according to claim 1, wherein said selector rail is connected by a pin to said pressure bar at an elongate slot thereof allowing said selector rail to reciprocate with respect to said pressure bar; and said pin connected to a selector lever to be engaged by a user.

3. The improvement according to claim 1, wherein said first groove formation comprises a shoulder formed around a circumference of said first punch and a C-clip engaged to said first punch around a circumference thereof spaced a discreet distance from said shoulder.

4. The improvement according to claim 1, wherein said pressure bar comprises a channel shape and said selector rail is guided for reciprocation within said channel shape.

5. The improvement according to claim 1, wherein said improvement further comprises a third punch and a fourth punch, said first, second, third and fourth punches arranged spaced apart along said pressure bar such that said second and third punches are spaced according to a standard two hole punch, and said first, third and fourth punches are arranged spaced corresponding to a standard three hole punch.

6. A punch press comprising:

a frame;

a cover overlying said frame;

first, second, third and fourth punches arranged within said cover and guided by said frame;

a pressure bar mounted for reciprocal movement within said cover;

said cover having a paper receiving slot in registry with said first, second, third and fourth punches;

a motor means to reciprocate said pressure bar toward and away from said slot;

said first and second punches fixedly connected to said pressure bar for reciprocation therewith toward and away from said paper receiving slot;

said second and third punches alternately selectable to reciprocate with said pressure bar toward and away from said paper receiving slot;

means for alternately selecting said third and fourth punches to reciprocate with said pressure bar, said means mounted for movement with respect to said frame within said cover, said means having a selector lever extending through said cover and operable by a user to selectively activate one of the third and fourth punches.

7. The punch press according to claim 6, wherein said means for selecting comprises a selector rail mounted reciprocally with respect to said pressure bar, and said third and fourth punches are carried on said pressure bar in oversized apertures, and said third and fourth punches comprise groove formations thereon for alternate engagement by said selector rail when shifted between a first position and a second position respectively.

8. The punch press according to claim 7, wherein said pressure bar comprises a channel-shaped cross section and said selector rail is mounted reciprocally within said channel-shaped cross section, said selector rail being guided by pins along said pressure bar and having facing notch formations for alternately engaging said groove formations of said third and fourth punches.

9. The punch press according to claim 6, wherein said groove formation of said third punch comprises a shoulder portion formed on an outer circumference of said punch and a C-clip surrounding said outer circumference of said punch and spaced a distance from said shoulder portion.

10. A punch press comprising:

a frame;

a cover overlying said frame and having a paper receiving slot;

a plurality of punches arranged within said cover and guided by said frame;

a pressure bar mounted for reciprocal movement within said cover;

a means to reciprocate said pressure bar toward and away from said slot;

said plurality of punches arranged to include at least two hole patterns corresponding to selected groups of punches;

means for selectively fixing said selected group of punches to said pressure bar for reciprocal movement with said pressure bar to punch paper and be retracted thereafter, said means mounted for reciprocal movement with respect to said frame within said cover, said means having a selector lever extending through said cover and operable by a user to select one of said two groups of punches.

11. The punch press according to claim 10, wherein said means for selecting comprises a selector rail mounted reciprocally with respect to said pressure bar, and at least one of said punches is carried on said pressure bar in an oversized aperture, and includes a groove formation thereon for selective engagement by said selector rail into said groove formation.

12. The punch press according to claim 11, wherein said pressure bar comprises a channel-shaped cross section and said selector rail is mounted reciprocally within said channel-shaped cross section, said selector rail being guided by pins along said pressure bar and having a facing notch formation for selectively engaging said groove formation of said at least one punch.

13. The punch press according to claim 12, wherein said at least one punch comprises a spring biasing said punch against said frame to a retracted position from said slot.

14. The punch press according to claim 13, wherein said means to reciprocate said pressure bar comprises:

an electric motor;

a cam shaft;

a roller connected eccentrically to said cam shaft and engaged to said pressure bar;

gear means for transferring rotary power from said electric motor to said cam shaft.

* * * * *